US005335931A

United States Patent [19]

Lacroix et al.

[11] Patent Number: 5,335,931

[45] Date of Patent: Aug. 9, 1994

[54] SKI HAVING AN UPPER FACE OF VARIABLE WIDTH

[75] Inventors: Jacques Lacroix, Annecy; Herve Andrevon, Doussard; Dominique Deville, Annecy le Vieux, all of France

[73] Assignee: Salomon S.A., Courbevoie, France

[21] Appl. No.: 990,402

[22] Filed: Dec. 14, 1992

[30] Foreign Application Priority Data

Dec. 13, 1991 [FR] France ..... 91 15831

[51] Int. Cl.[5] ..... A63C 5/04

[52] U.S. Cl. ..... 280/602; 280/607

[58] Field of Search ..... 280/602, 607, 609

[56] References Cited

U.S. PATENT DOCUMENTS

| | | | |
|---|---|---|---|
| 4,953,884 | 9/1990 | Diard et al. | 280/609 |
| 4,961,592 | 10/1990 | Diard et al. | 280/609 |
| 4,971,349 | 11/1990 | Diard et al. | 280/609 |
| 5,002,300 | 3/1991 | Pascal et al. | 280/602 |
| 5,035,442 | 7/1991 | Arnsteiner | 280/602 |

FOREIGN PATENT DOCUMENTS

| | | |
|---|---|---|
| 2522978 | 9/1983 | France . |
| 2553669 | 4/1985 | France . |
| 2598929 | 11/1987 | France . |
| 2598932 | 11/1987 | France . |

*Primary Examiner*—Joseph D. Pape

*Attorney, Agent, or Firm*—Pollock, Vande Sande & Priddy

[57] ABSTRACT

Ski shaped like an elongated beam, comprising a lower slide face bounded laterally by two lower edges, an upper face bounded laterally by two upper edges, and two lateral faces, the ski being constituted by a central part extended toward the front by a front part ending, at its front end, by the tip and extended toward the rear by a rear part ending, at its rear end, in the heel-piece. The front part is constituted by a front section connected to the central part by a front intermediate connection section, while this rear part is formed by a rear section connected to the central part by a rear intermediate connection section. The two upper edges of the upper surface are parallel in the central part, while one of the two front or rear section is such that, in this area, first, the lateral faces are inclined so as to converge upward, and second, the upper surface is narrower than it is in the central part and has a uniform width.

11 Claims, 5 Drawing Sheets

14
11
1
2
6
L
e
3
12
16

P
AV
14
13
I
H
11
III
III
7a
8a
la
La
25
18
IV
IV
J
L
26
7ia
8ia
19
A
C
V
V
9
10
6
lc
170
17
VI
VI
l
7c
8c
Lc
VII
VII
B
D
21
24
7ir
8ir
VIII
E
G
VIII
20
22
7r
8r
Lr
IX
IX
lr
F
H
12
15
16
AR
P'

FIG. 13
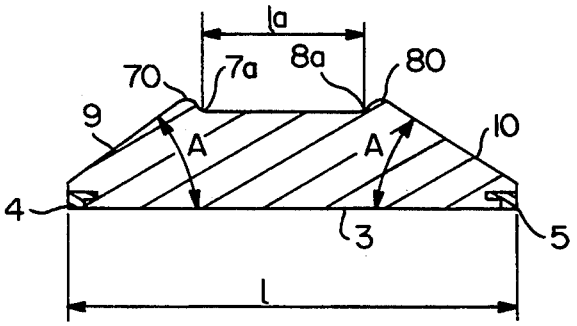
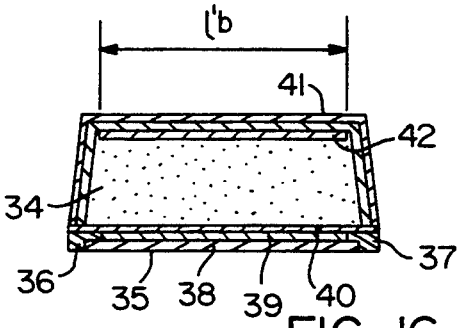
FIG. 16
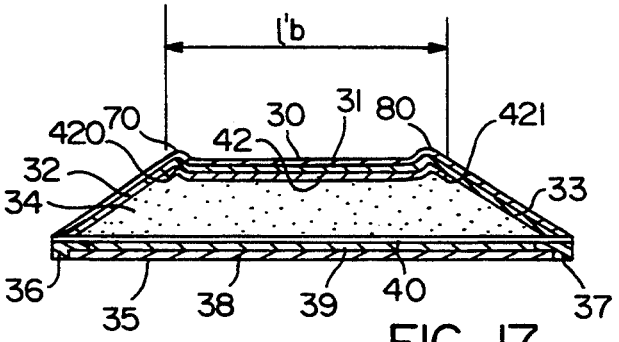
FIG. 17
FIG. 18
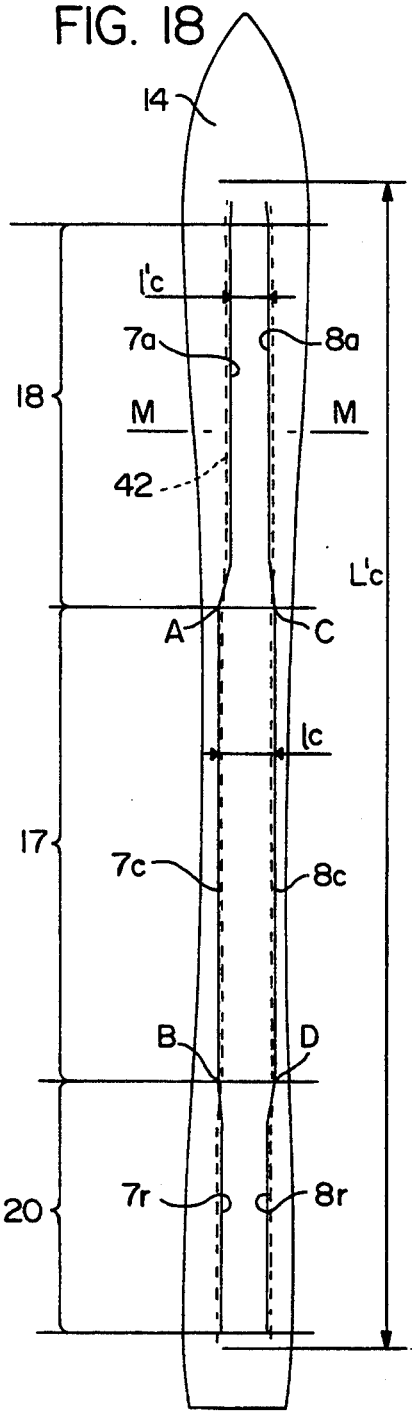

SKI HAVING AN UPPER FACE OF VARIABLE WIDTH

FIELD OF THE INVENTION

The present invention relates to an alpine ski, a cross-country ski, a monoski, or a snow surfing ski. More specifically, it relates to an improvement made to this type of ski.

BACKGROUND OF THE INVENTION

Skis used especially in alpine skiing are constituted by an elongated beam ending, at the front, in a tip, and, at the rear, in a heel-piece. The thickness of the ski is generally greater in the central portion, and gradually diminishes toward the ends, so that the ski forms, as it were, a beam exhibiting specialized flection.

Present-day skis normally have a composite structure, in which different materials are combined so that each of them comes optimally into play, given the distribution of the mechanical stresses generated when the ski is used. Thus, the structure generally comprises peripheral protective elements, internal strengthening elements designed to withstand flectional and torsional stresses, and a core, as well as sliding and attachment components. These elements are assembled by adhesive bonding or injection, and assembly generally takes place under heat in a mold having the final shape of the ski, comprising a front portion raised in pronounced fashion to form a tip, a rear portion slightly raised to form a heel-piece, and a cambered central part.

Despite the manufacturers' interest in producing quality skis, they have not, to date, produced a high-performance ski which proves satisfactory under all conditions of use.

It is known that the size and structural characteristics of the ski determine the characteristics allowing good performance, its dimension line making it possible to maneuver the ski in turns while promoting its strength under curvature, and its thickness line permitting proper adjustments under flection. The edge line allows adjustment of torsion.

French Patent Publication No. 2 522 978 discloses the use of a ski whose lateral faces are inclined uniformly or variably, in order to reduce lateral friction during the execution of turns. Such inclination is variable, in particular, to allow adaptation to variations in width of the upper surface of the ski, occurring in the direction of a curvilinear narrowing in the area of the central zone. In the area of the bindings, the width may be uniform, as shown in FIG. 1 of the patent so as to create a platform capable of receiving the bindings. This ski shape requires a complex manufacturing process, because of the fact that the upper edges are curvilinear over a large part of the ski length. This problem arises, in particular, in modern ski structures utilizing pre-impregnated fibrous reinforcement pieces, since bending in the area of the edges is difficult and the fibers cannot be arranged evenly in the area of these upper edges. As a result, edges are weaker mechanically. Furthermore, the non-rectilinear edges of the upper face do not provide simple, effective markings for decoration of the upper face using sublimation means, for example.

Applicant's French Patent No. 2 598 930 concerns a ski whose upper platform has a constant width over the entire length of the ski and whose edges have variable inclination allowing adaptation to the variations in width of the sliding surface, or dimension line, of the ski. This type of ski has a number of advantages prior art skis, yet is not completely satisfactory for some grades of snow and kinds of skiers, for whom skiing requires a number of further improvements.

SUMMARY OF THE INVENTION

The present invention concerns, first, improvements made to these skis for the purpose of facilitating manufacture, and second, gives the desired ski-performance, comfort, and strength characteristics.

Accordingly, the ski according to the invention has the shape of an elongated beam comprising a lower sliding surface bounded laterally by two lower edges, an upper face bounded laterally by two upper edges, and two lateral faces, and is constituted by a central part extended forward by a front part ending, at the front, in a tip and extended rearward by a rear part ending, at its rear end, in a heel-piece, this front part being connected to the central part by means of an intermediate front-connection section, while the aforementioned rear part is attached to the central part by a rear connection section, the two upper edges belonging to the upper surface being parallel in the central part, while either of the front or rear sections is such that, in this zone, first, the lateral faces are inclined so as to converge upward, and second, the upper surface is narrower than it is in the central part and has a uniform width.

The fact that the ski has sections of uniform width or has parallel upper edges is intended to facilitate ski manufacture, especially the cutting and installation of an additional upper reinforcement piece, and to improve the strength of the upper edges in these sections. The fact that at least one of either of the front or rear section has an upper surface whose width is less than that of the central part makes it possible, while maintaining the aforementioned advantages, first, to have available sufficient space for positioning of the bindings, and second, to have available a ski whose torsion and flection values are capable of greater variation, as a function of the longitudinal position in question, than are the values of conventional skis.

In accordance with one embodiment, the front section is such that its upper surface is narrower than in the central part, and it is bounded by the two lateral, parallel, edges.

According to another embodiment, the rear portion is such that its upper surface is narrower than in the central part, and it is bounded by the two lateral, parallel edges.

The width of the upper surface of the front section may or may not be equal to the width of the upper surface of the rear section.

According to a preferred embodiment, the lateral faces are, in addition, inclined in the central part of the ski, so as to converge symmetrically upward in relation to the median axis of the ski.

According to one advantageous configuration, the angle of inclination of the lateral faces varies continuously, in such a way that the angle of inclination diminishes gradually as it extends from the center toward the ends.

The invention makes possible optimization of torsional stiffness without modifying the thickness of the ski or the dimension line. In fact, by modifying the width of the top of the ski, the desired characteristics of behavior under torsion of the ski can be obtained.

BRIEF DESCRIPTION OF THE DRAWINGS

Other features and advantages of the invention will emerge from the following description provided with reference to the attached drawings given solely by way of example, and in which:

FIG. 1 is a lateral view of the ski according to the invention.

FIG. 2 is a top plan view of the ski in FIG. 1.

FIGS. 3 to 9 are transverse cross-sectional views along lines III—III, IV—IV, V—V, VI—VI, VII—VII, VIII—VIII, and IX—IX, respectively, in FIG. 2.

FIG. 10 is a graph showing the variation of inclination of the lateral faces of the ski.

FIG. 13 is a view similar to FIG. 4, illustrating another variant.

FIG. 16 is a cross-section view of the structure of the ski in FIG. 14, along line N—N.

FIG. 17 is a cross-section view of FIG. 14 and FIG 18, along line M—M.

FIG. 18 is a top plan view of the ski, illustrating, more specifically and in dotted lines, the reinforcement layer (42).

DETAILED DESCRIPTION

Figure 1:
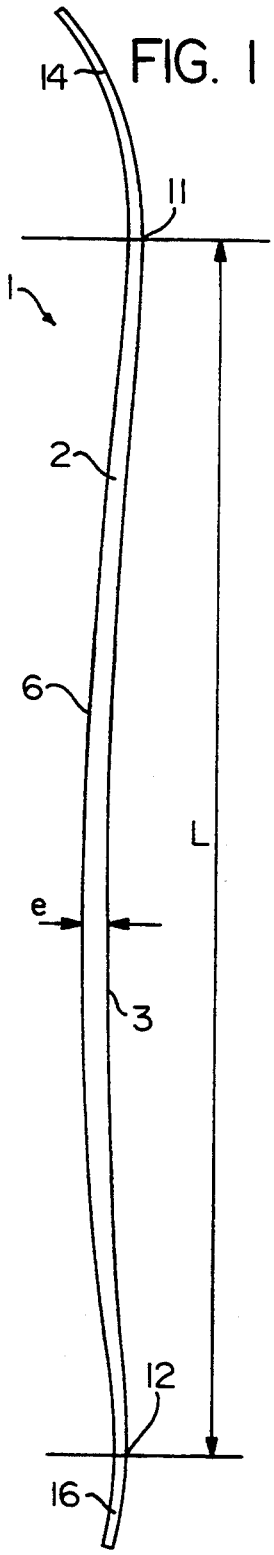
FIGS. 1 to 10 illustrate a first embodiment of a ski according to the invention.
Figure 2:
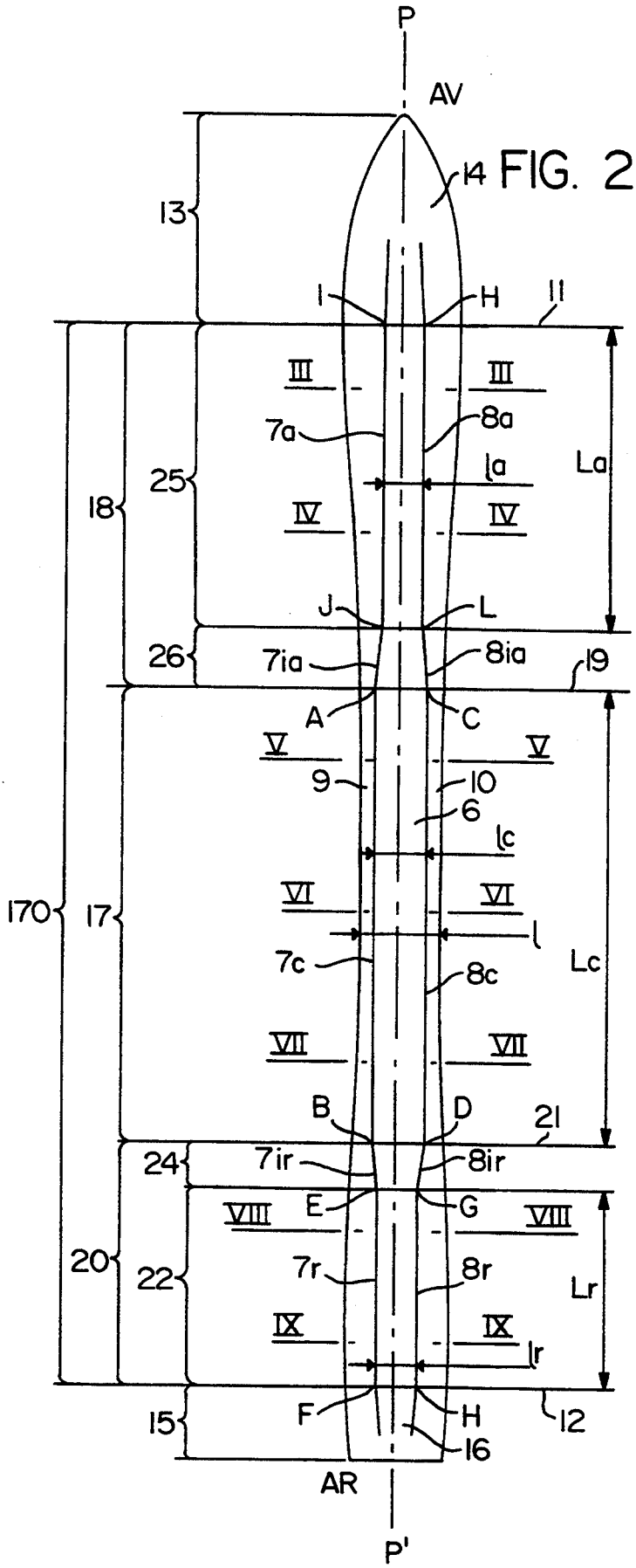
Figure 3:
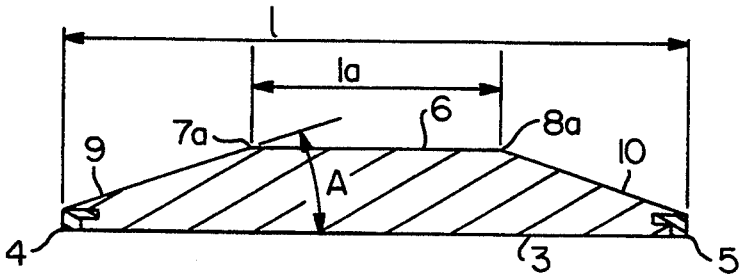
Figure 4:
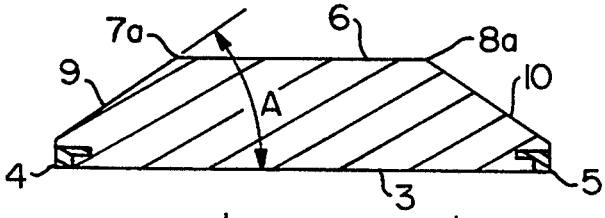
Figure 5:
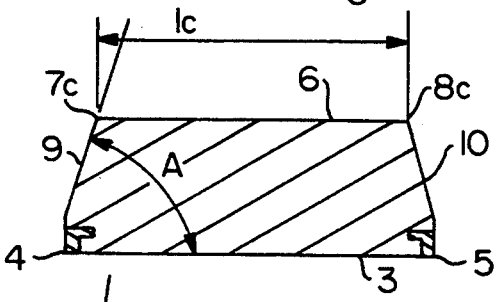
Figure 6:
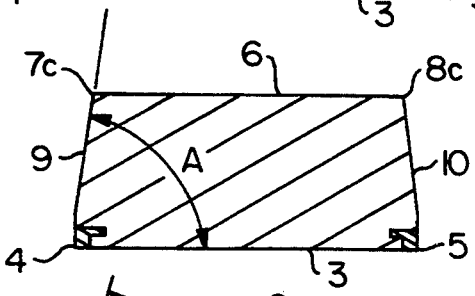
Figure 7:
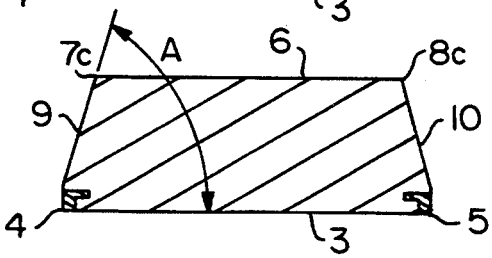
Figure 8:
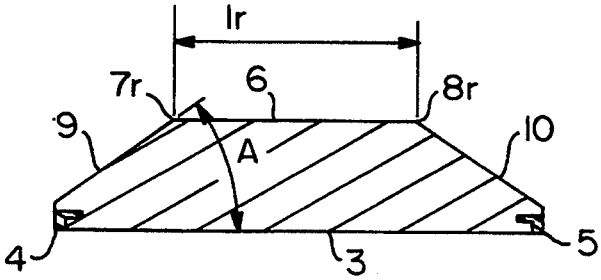
Figure 9:
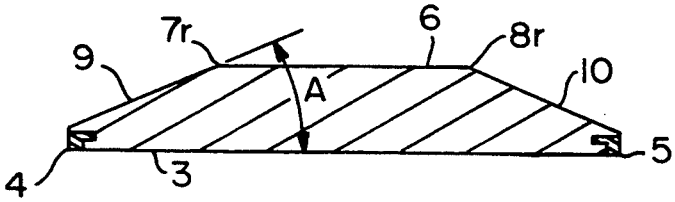

As is conventionally known and as shown in the drawings, the ski 1 according to the invention is shaped like an elongated beam 2 comprising a lower sliding surface 3 bounded laterally by two lower edges 4, 5. It comprises, among other elements, an upper surface 6 bounded laterally by two upper edges 7, 8 and two lateral faces 9, 10 connecting the lower edges 4, 5 to the upper edges. The body of the ski itself extends between a front contact line 11 and a rear contact line 12, so as to be extended forward by means of a raised front part (13) forming the tip (14) and rearward by means of a shorter rear part 15 raised to a lesser degree and forming the heel-piece 16.

FIG. 1 shows that the ski body contained between the front and rear contact lines 11 and 12 is, in conventional fashion, slightly cambered in the resting position in the absence of load and has its own thickness distribution. Thus, the thickness e is at a maximum in the central zone and diminishes gradually, for example, toward the front AV and the rear AR.

The ski according to the invention comprises a central part 17 extended forward by a front part 18 extending from the front end 19 of the central part 17 to the front contact line 11, and a rear part 20 extending from the rear end 21 of the central part 17 to the rear contact line 12. The central part 17 of the ski corresponds to the central mounting area of the bindings, and extends, for example, over a length lc which may range between 40 and 70 centimeters, and may, for example, be 60 centimeters.

According to one of the invention features, the upper surface of the ski 6 in the central part 17 has a uniform width lc. Accordingly, the upper surface 6 of the central part 7 is bounded laterally by two rectilinear, parallel lateral edges *7c, 8c,* formed by two rectilinear, parallel segments AB and CD respectively, which are separated by a uniform distance lc.

According to another feature, the rear part is constituted by two distinct sections 22, 24, a first intermediate section 24 attached to the central part 17 and a rear section 22, such that, in the latter, the upper surface of the ski 6 has, on the one hand, a width lr less than the width lc of the central part, and is bounded laterally by two parallel rectilinear edges *7r* and *8r*. The aforementioned width lr is uniform over the second rear section 22 of the rear part 20 of the ski. This second rear section extends forward beginning in the area of the rear contact line 12 and over a distance Lr which may be between 5 and 30%, and for example, 18%, of the length of a ski having a length L of two meters. The upper surface 6 of the second rear section 22 is thus bounded laterally by two edges formed by two rectilinear, parallel segments EF, GH, separated by a uniform distance lr which is less than lc. Since the rear section, in which the width of the upper surface is uniform, extends over a relatively substantial length, this rear section is attached to the central part by an intermediate rear connecting section 24, whose upper surface is bounded laterally by two edges *7ir, 8ir* which diverge toward the front and which are formed by the two segments BE and DG which converge to the rear.

According to an additional feature, the front part 18 is constituted by two distinct sections 25, 26, i.e., a first intermediate section 26 attached to the central part 17 and a second front section 25 such that, in the latter, the upper surface of the ski has a width la less than the width lc of the central part 17 and is bounded laterally by two lateral edges *7a, 8a* extending rectilinearly and parallel to each other. Thus, this width la is uniform over the front section 25 of the front part 18 of the ski. This front section 25 extends rearward beginning in the area of the front contact line 11 over a distance La which may range between 8 and 45%, and may, for example, be 22%, of a ski having a length L equal to two meters. The upper surface 6 of the front section 25 is thus bounded laterally by two edges constituted by two rectilinear, parallel segments IJ, HL separated from each other by a uniform distance la less than lc. Since the front section, in which the width of the upper surface is uniform, extends over a relatively substantial length, this front section is connected to the central part by an intermediate front connection section 26 whose upper surface is bounded laterally by two lateral edges *7ir, 8ir* converging toward the front and formed by the two segments JA and LC, which converge toward the front.

According to a complementary characteristic and in order to allow connection of the lower surface 3 to the upper surface 6 while taking into account the variations of thickness e and width 1 of the upper surface 6, the lateral faces 9, 10 are inclined so as to converge upwardly, at least in the front and rear parts 18 and 20, so as to form an acute angle A allowing adaptation to the variations of width 1 of the upper and also lower surfaces of the ski.

According to a preferred embodiment, since the width of the lower surface is greater than the width of the upper surface at any point taken on the length of the ski, the lateral faces 9, 10 too are inclined in the central zone and the inclination is variable along the ski. In fact value A of the angle of inclination varies as a function of the longitudinal position of the section in question as shown in FIGS. 3 to 9, and more particularly in FIG.

10. We should also note that angle A is, advantageously, greater in the central part than in the front and rear sections. Moreover, the variation of inclination is advantageously continuous and progressive and angle A diminishes uniformly and gradually from the center of the ski toward the ends. In the preferred embodiment illustrated in FIGS. 1 to 9, the lateral faces 9, 10 are symmetrical in relation to the vertical median longitudinal plane of symmetry P—P1 of the ski; of course, other configurations are possible.

Figure 11:
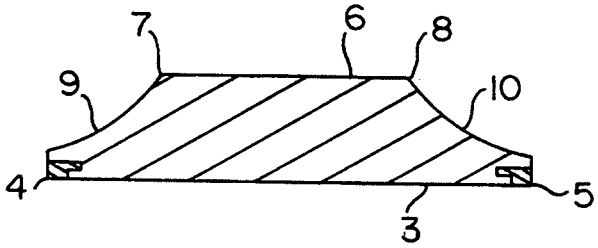
FIGS. 11 and 12 are views similar to FIG. 4, illustrating two variants.
Figure 12:
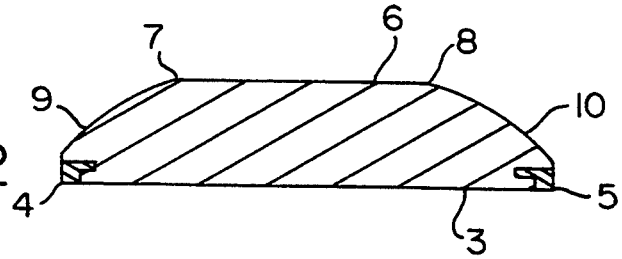

In the central part 17, angle A ranges for example between 55° and 90°, while in the front and rear sections, this angle will range, for example, between 15° and 90°. The lateral faces 9, 10 may be flat as shown in FIGS. 3 to 9; however they may also have a concave or convex curvilinear profile, as illustrated in FIGS. 11 and 12. The lateral faces may be flat in one part of the ski and curved in one or the other of the sections, or vice-versa.

Figure 10:
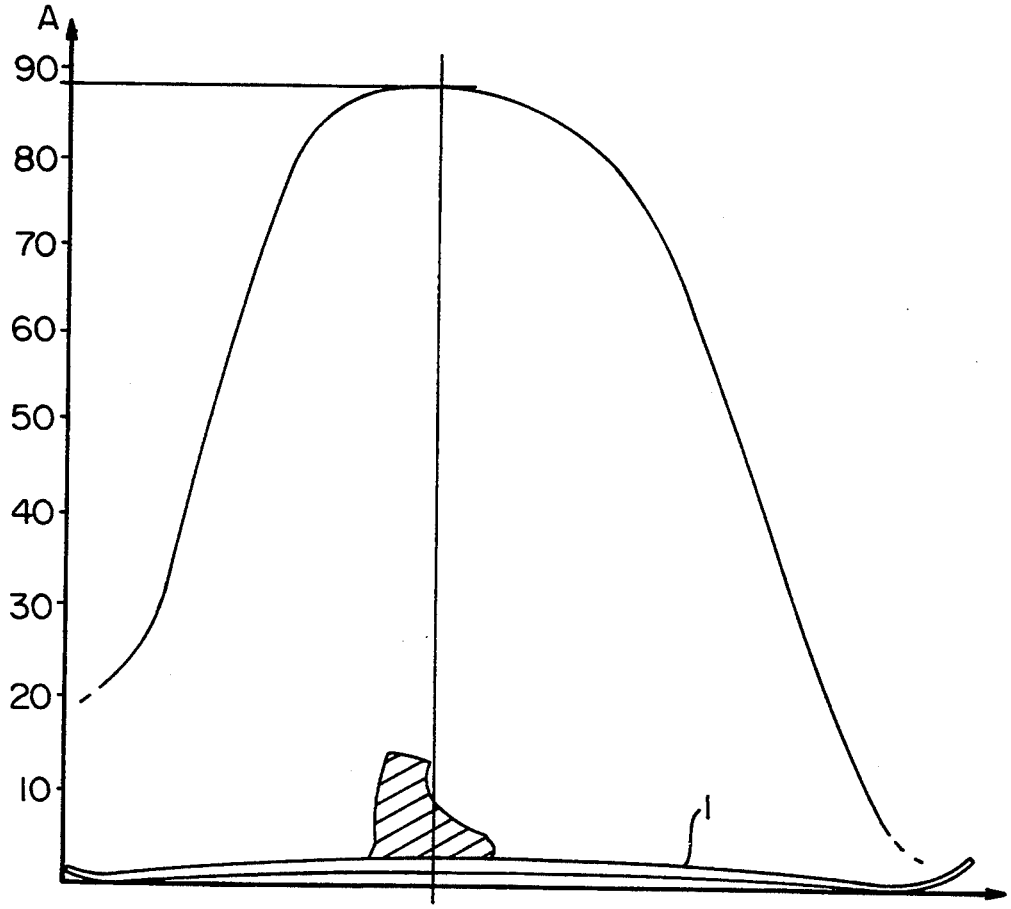

FIG. 10 illustrates an example of a graph showing variation of the angle of inclination A as a function of position along the ski 1. The values of the angles A are referenced on the ordinate, while the position taken along the ski 1 is referenced on the abscissa.

FIG. 13 illustrates a variant of a ski in transverse cross-section, in which the lateral edges of the upper surfaces 6 of the front and rear sections 25 and 22 comprise, over at least a portion of their lengths, longitudinal projections 70, 80, designed to protect the upper surface 6, which, at these points, is especially subject to blows, e.g., from ski edges.

Figure 14:
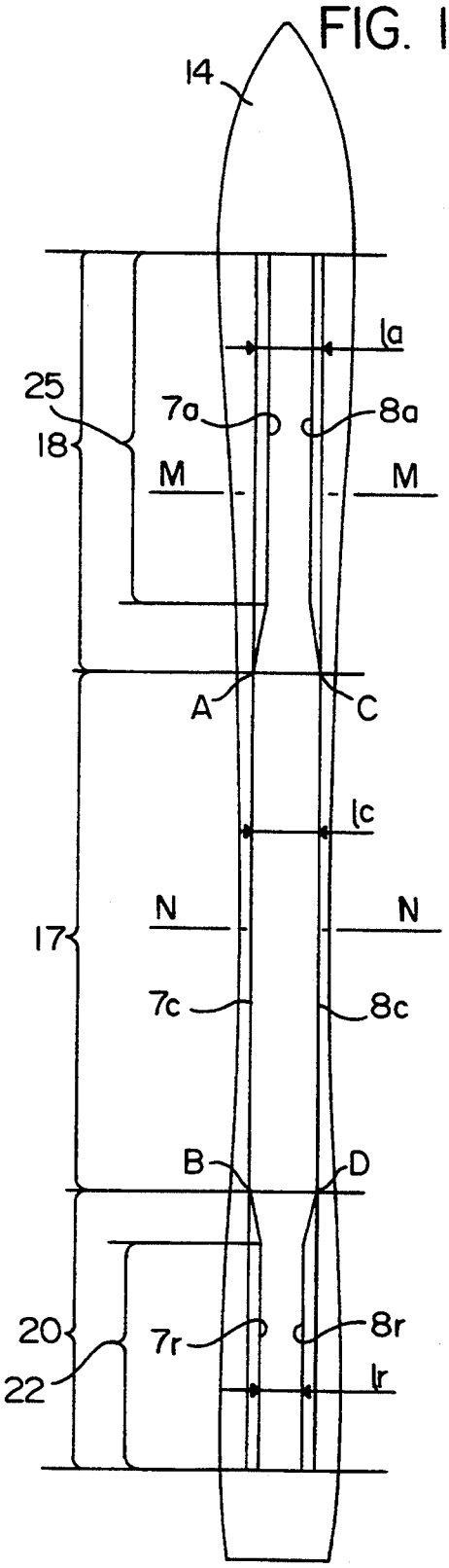
FIGS. 14 and 15 are top plan views of two examples of a ski according to the variant in FIG. 13.
Figure 15:
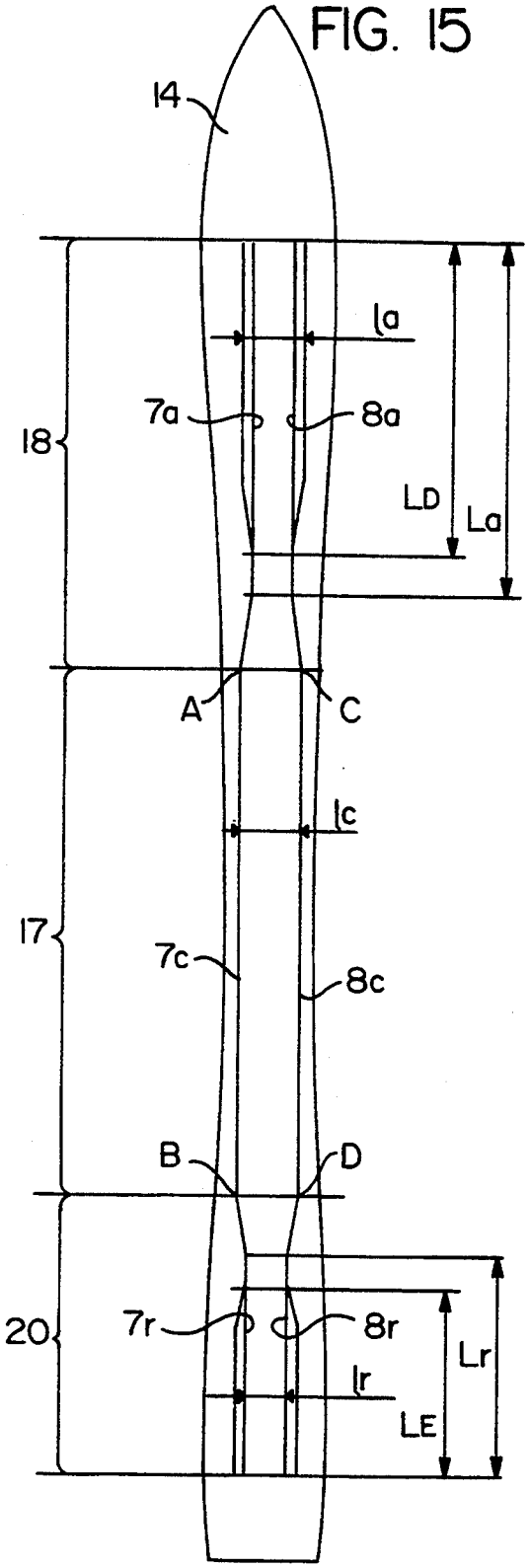

In the embodiment shown in FIG. 14, the longitudinal projections extend over the entire length of the front section 18 and of the rear section 20. In the embodiment shown in FIG. 15, the projections extend over only a portion of the length LD and LE of the front and rear sections 25 and 22, and have lengths La and Lr, respectively.

The ski structure may be of the sandwich or box type, or of any other kind. FIGS. 16, 17, and 18 show, by way of example, a preferred structure comprising a rigid first upper reinforcing piece 30 shaped like a shell having an inverted U-shaped section and forming an upper wall 31, and two lateral walls 32 and 33 enclosing a core 34, the lower part of this assembly being closed by an internal element 35 comprising metal edges 36, 37, a slide layer 38 generally made of polyethylene, and lower reinforcement pieces 39, 40. An upper surface layer 41 enclosing the upper reinforcement piece and forming the decoration completes the aesthetic appearance of the ski. A second upper reinforcement layer 42 is fitted beneath the first layer. This second layer 42 is constituted, for example, by a strip of uniform width l'b extending at least into the central part 17 having length L'c and designed to receive the bindings.

In FIG. 16, which illustrates a cross-section of the ski structure in the front section 18 of the ski, the second layer 42 extends beyond the central part 17 while maintaining uniform width. In this case, the width l'b is greater than the width la of the upper surface of the ski, and the edges 420, 421 of the second layer 42 are slightly curved upward inside grooves formed by longitudinal projections 70, 80, which thus strengthen the latter.

The reinforcement layers 30, 39, 40 may be of any type, e.g. layers of composite materials such as glass fibers, carbon fibers with epoxy or polyester resin, or a metal alloy. The core 34 may be foam, whether filled or unfilled, wood, or aluminum honeycomb. The surface layer 41 providing for decoration may be made of polyamide or other substances such as a thermoplastic material. This layer may be single- or multi-layered.

According to the embodiment shown in FIGS. 1 to 10, the width la of the upper surface 6 of the front section 25 equals the width lr of the upper surface 6 of the rear section 22. However, widths la and lr, while being smaller than the width la, could be different from each other. Accordingly, the width la of the upper surface 6 of the front section 25 could be smaller or larger than the width lr of the upper surface 6 of the rear section 22.

In the embodiment described above, the upper surface of the ski 6 was shown as a flat surface. It is evident, however, that this surface could have any other form, and, in particular, a curved shape, and, in this case, either convex or concave, or it could be constituted by a succession of surfaces of any kind.

Similarly, the embodiments described above included intermediate connection sections 24, 26 connecting the front and rear sections 25, 22 to the central part 17, and which are given material form by two lateral edges 7, 8 marked in such a way that they extend continuously along the ski. However, the lateral edges 7, 8 may be discontinuous in the area of the intermediate connection sections 24 26 without departing from the scope of the invention.

The term "discontinuity" signifies that the front part of the lateral edge does not attach directly to the rear portion of the lateral edge in the intermediate connection section. For example, the lateral edge can become indistinct in this area, if a tangent attachment radius connecting the lateral faces 9, 10 to the upper face 6 is provided, or it may deviate, if a secant radius with the upper surface 6 is provided.

What is claimed is:

1. Ski (1) shaped like an elongated beam (2) comprising a lower slide face (3) bounded laterally by two lower edges (4, 5), an upper face (6) bounded laterally by two upper edges (7, 9), and two lateral faces (9, 10), and constituted by a central part (17) extended forwardly (AV) by a front part (18) having a front end (13) ending in a tip (14) and extended rearwardly (AR) by a rear part (20) having a read end (15) ending in a heel-piece (16), wherein said front part (18) is constituted by a front section (25) connected to the central part (17) by an intermediate attachment section (26), while said rear part (20) is constituted by a rear section (22) connected to said central part (17) by a rear intermediate attachment section (24) and the two upper edges (7c, 8c) of said upper face (6) are parallel in said central part (17), while, at one of said front and rear sections (22, 25) said lateral faces (9, 10) are inclined so as to converge upwardly, and at the other of said front and rear sections, said upper surface is narrower than it is in said central part and has a uniform width (la, lr).

2. Ski according to claim 1, wherein said upper face (6) of said front section (25) is narrower than in said central part (17) and is bounded by said two lateral, parallel edges (7a, 8a–7r, 8r).

3. Ski according to claim 1, wherein said upper face (6) of said rear section (22) is narrower than in said central part (17) and is bounded by said two lateral, parallel edges (7a, 8a–7r, 8r).

4. Ski according to claim 3, wherein the width (la) of said upper surface (6) of said front section (25) is equal to the width (lr) of said upper surface (6) of said rear section (22).

5. Ski according to claim 3, wherein the width (la) of said upper surface (6) of said front section (25) is different from the width (lr) of said upper surface (6) of said rear section (22).

6. Ski according to claim 5, wherein the width (la) of said upper surface (6) of said front section (25) is greater than the width (lr) of said upper surface (6) of said rear section (22).

7. Ski according to claim 5, wherein the width (la) of said upper surface (6) of said front section (25) is smaller than the width (lr) of said upper surface (6) of said rear section (22).

8. Ski according to claim 1, wherein, in said front and rear parts (18, 20), said lateral faces (9, 10) are inclined so as to converge upward.

9. Ski according to claim 8, wherein said lateral faces are inclined by an angle which varies continuously in such a way that said angle of inclination (A) is greater in said central part than in said front and rear sections.

10. Ski according to claim 1 comprising a core (34) positioned between two reinforcement pieces, at least one upper reinforcement piece (31) and at least one lower reinforcement piece (40).

11. Ski according to claim 10, wherein said upper reinforcement piece is shaped like an inverted U and comprises an upper wall extended downward on each side by a lateral wall running downward.

* * * * *

UNITED STATES PATENT AND TRADEMARK OFFICE

CERTIFICATE OF CORRECTION

PATENT NO. : 5,335,931

DATED : August 9, 1994

INVENTOR(S) : Lacroix et al

It is certified that error appears in the above-indentified patent and that said Letters Patent is hereby corrected as shown below:

On the title page, item: [73] Assignee, change "Courbevoie" to --Chavanod--;

In the Abstract, the tenth line of text, change "this" to --the--;

n column 6, line 44, claim 1, change "read" to --rear--.

Signed and Sealed this

Seventh Day of November, 1995

*Attest:*

*Attesting Officer*

Bruce Lehman

BRUCE LEHMAN

*Commissioner of Patents and Trademarks*